United States Patent [19]

Trombetta

[11] Patent Number: 4,953,248

[45] Date of Patent: Sep. 4, 1990

[54] ELECTRICIAN'S COMPOUND TOOL

[76] Inventor: Thomas L. Trombetta, 3943 Roselle Ave., Modesto, Calif. 95355

[21] Appl. No.: 473,827

[22] Filed: Feb. 2, 1990

[51] Int. Cl.[5] ..... B25F 1/00

[52] U.S. Cl. ..... 7/107; 7/127; 7/132; 7/137

[58] Field of Search ..... 7/107, 125, 127, 132, 7/137, 143, 144, 158

[56] References Cited

U.S. PATENT DOCUMENTS

| | | | |
|---|---|---|---|
| 276,793 | 5/1883 | Erdman et al. | 7/132 X |
| 784,959 | 3/1905 | Morris | 7/137 X |
| 790,432 | 5/1905 | Heilrath | 7/132 X |
| 1,024,120 | 4/1912 | Crossley | 7/137 X |
| 1,532,147 | 4/1925 | MacPherson | 7/137 X |
| 1,572,898 | 2/1926 | Martin . | |
| 1,939,574 | 12/1933 | Saylor . | |
| 2,462,250 | 2/1949 | Andrews . | |
| 2,572,237 | 10/1951 | Andrews | 7/137 X |
| 2,654,120 | 10/1953 | Tifft | 7/132 X |
| 3,447,172 | 6/1969 | Clark . | |
| 3,525,107 | 8/1970 | Hays . | |
| 3,733,626 | 5/1976 | Allen . | |
| 3,906,561 | 9/1975 | Bawa | 7/132 X |
| 3,947,905 | 4/1976 | Neff . | |
| 4,028,756 | 6/1977 | Couto . | |
| 4,225,990 | 10/1980 | Theiler, Sr. . | |
| 4,614,001 | 9/1986 | Liou | 7/137 |
| 4,625,596 | 12/1986 | Makus . | |

*Primary Examiner*—James G. Smith

*Attorney, Agent, or Firm*—Shlesinger & Myers

[57] ABSTRACT

A hand tool comprises first and second members pivotally connected to each other with a pivot. The first and second members include first and second handle portions, respectively, on one side of the pivot and first and second jaw portions, respectively, on the other side of the pivot. The first and second jaw portions are positionable between closed and open positions when the handle portions are brought together or spread apart, respectively. First and second cooperating cutter blades are disposed on the first and second jaw portions, respectively, for cutting when the first and second jaw portions are closed. The first and second cutter blades include first and second straight cutting edge portions, respectively, and at least first and second arcuate edge portions, respectively. The arcuate edge portions form a circular cutter when the first and second jaw portions are closed. One of the first and second jaw portions includes an outward transverse extension terminating in a hammer head extending laterally outwardly of the handle portions when brought together. The other of the first and second jaw portions includes an outward transverse extension terminating in a pivotable knife blade having a first protected position and a second exposed position.

25 Claims, 2 Drawing Sheets

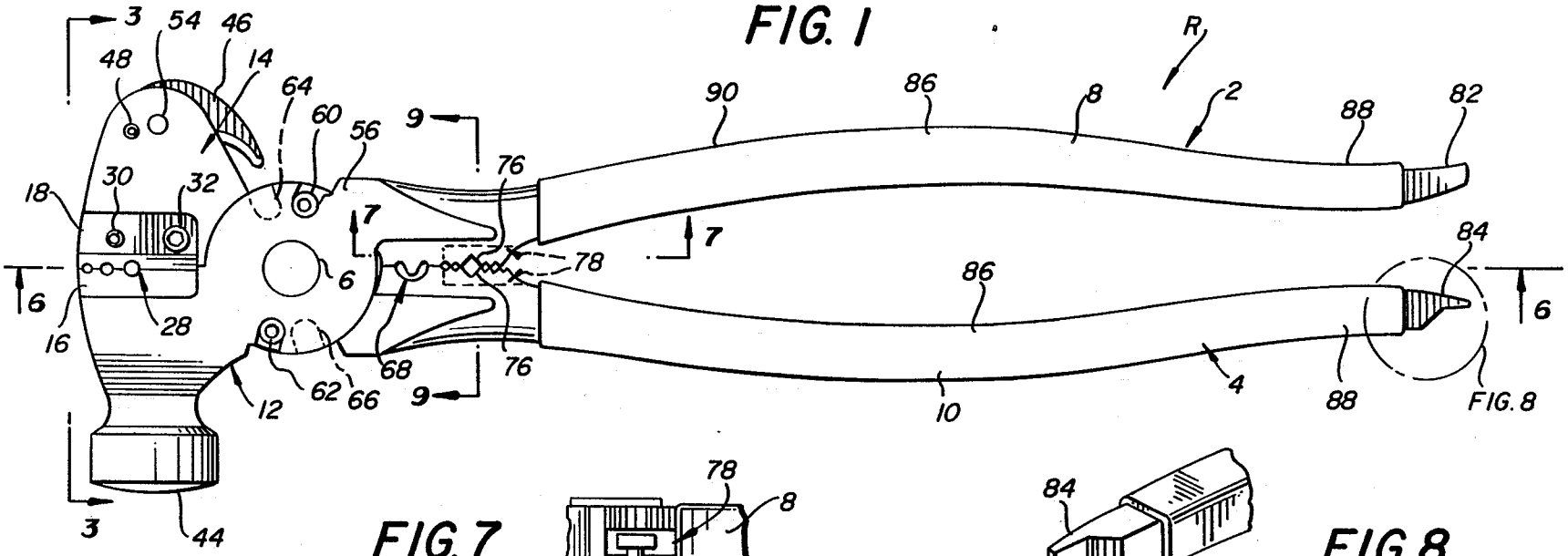
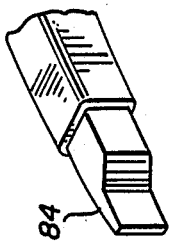
FIG. 8
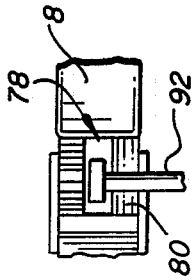
FIG. 7
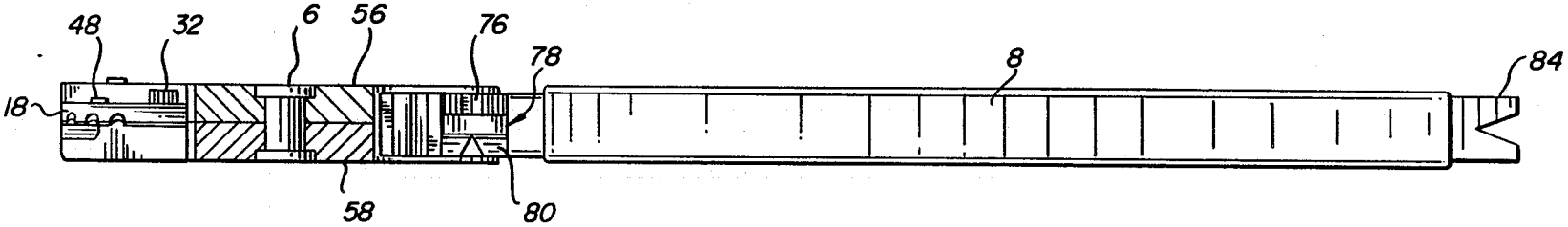
FIG. 6
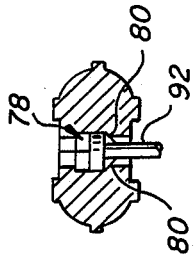
FIG. 9

ELECTRICIAN'S COMPOUND TOOL

FIELD OF THE INVENTION

The present invention relates generally to an electrician's hand tool, and in particular to a compound tool incorporating several tools commonly used by an electrician.

BACKGROUND OF THE INvENTION

An electrician uses several individual tools when wiring a house or building. The tools normally used include a pair of pliers, a wire cutter, a wire stripper, a knife, a screw driver, a hammer, a crimper, and a bolt cutter. The stripper, wire cutter, crimper and bolt cutter have been known to be combined in one tool. The hammer, screw driver, knife and pair of pliers are typically individual tools. It is advantageous for the electrician to have a single tool that incorporates all of these individual tools. The electrician saves time by having most of the tools he needs in his grasp, saving the time used in switching tools. The electrician also avoids carrying the additional weight of the individual tools.

OBJECTS AND SUMMARY OF THE INVENTION

It is therefore an object of the present inVention to provide an electrician's compound tool which incorporates most of the tools commonly used by an electrician in one compact hand tool.

It is another object of the present invention to provide an electrician's compound tool which saves an electrician the time required for switching tools as when using individual tool.

It is still another object of the present invention to provide an electrician's compound tool which permits an electrician to avoid carrying the extra weight of an assortment of individual tools.

It is yet another object of the present invention to provide an electrician's compound tool which includes a hammer head, a wire cutter, a wire stripper, a knife, a crimper, a pair of pliers, a bolt cutter, a claw and a screw driver.

It is still another object of the present invention to provide an electrician's compound tool which includes a wire cutter and a knife with replaceable blades.

It is still further another object of the present invention to provide an electrician's compound tool which includes a pivotable knife positionable in a closed position for preventing a user from being accidentally cut.

It is an object of the present invention to provide an electrician's compound tool which includes relatively longer handles for greater mechanical advantage.

It is another object of the present invention to provide an electrician's compound tool which is comfortable to handle.

In summary, the present invention provides an electrician's compound tool which provides in one handy tool most of the tools which an electrician commonly uses in wiring a house or building, thereby saving time and effort.

These and other objects of the present invention will become apparent from the following detailed description.

BRIEF DESCRIPTIONS OF THE DRAWINGS

FIG. 1 is a top plan view of an electrician's compound tool according to the present invention, with portions shown in dashed lines.

FIG. 6 is an elevational view, partly in cross-section, taken along line 6—6 in FIG. 1.

FIG. 7 is a fragmentary sectional view taken along line 7—7 in FIG. 1.

FIG. 8 is a fragmentary. perspective view taken from Detail 8 in FIG. 1.

FIG. 9 is a cross-sectional view taken along line 9—9 in FIG. 1.

DETAILED DESCRIPTION OF THE INvENTIoN

Figure 2:
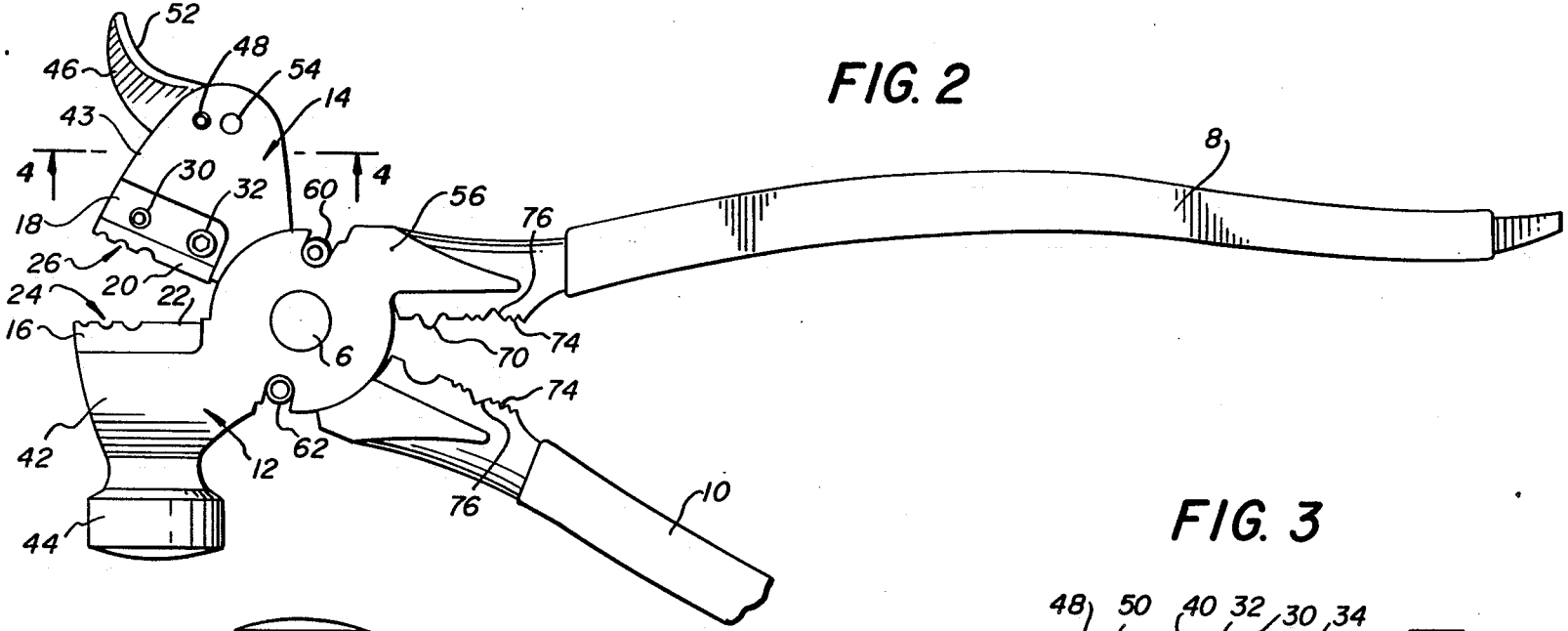
FIG. 2 is a top plan view of the tool of FIG. 1 shown in an open position.

An electrician's compound tool R according to the present invention is disclosed in FIG. 1. The tool R includes a pair of pivoting members 2 and 4 about a pivot 6. The members 2 and 4 include handle portions 8 and 10, respectively, on one side of the pivot 6, and jaw portions 12 and 14, respectively, on the other side of the pivot 6. The handle portions 8 and 10 are operable between an open position when the handle portions 8 and 10 are apart from each other and a closed position when they are adjacent each other, as best shown in FIGS. 1 and 2, respectively. The jaw portions 12 and 14 are apart from each other when the handle portions 8 and 10 are in the open position, and are adjacent each other when the handle portions 8 and 10 are in the closed position, as best shown in FIGS. 1 and 2.

Cutter blades 16 and 18, having straight cutting edge portions 20 and 22, respectively, are secured to the jaw portions 12 and 14, respectively, such that the straight cutting edge portions 20 and 22 are effective in cutting a wire disposed therebetween when the jaw portions 12 and 14 are brought to the closed position. The cutter blades 16 and 18 also include a series of discrete arcuate cutting edge portions 24 and 26, respectively, which form a series of circular cutters 28 when the cutting blades 16 and 18 are brought together, as shown in FIGS. 1 and 2. The circular cutters 28 are used for cutting and stripping the insulation of an electrical wire and are sized for different gauges of wire. Each of the circular cutters 28 decreases in diameter in a direction away from the pivot 6. The circular cutters nearer to the pivot 6 are for larger gauge wires, to take advantage of the greater forces generated nearer the pivot 6. Likewise, the straight cutting edge portions 20 and 22 are disposed closer to the pivot 6 to advantageously use the larger leverage forces generated nearer the pivot 6, thereby making it relatively easier to cut wires.

The cutter blades are advantageously disposed forward of the pivot 6 to afford ease of use, since cutting and stripping wires are typically the more common work involved in a wiring job.

Figure 3:
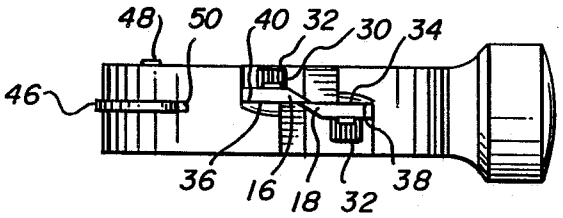
FIG. 3 is a top end elevational view of the tool of FIG. 1 as viewed along line 3—3 in FIG. 1.

The cutter blades 16 and 18 are removably secured to the jaw portions 12 and 14 by means of rolled spring metal pins 30 and bolts 32, as best shown in FIGS. 1, 2 and 3. The jaw portions 12 and 14 include recesses 34 and 36, respectively, with respective flat surfaces 38 and 40 on which the cutter blades 16 and 18 are respectively disposed, as best shown in FIG. 3. The cutter blades 16 and 18 preferably overlap each other when they are in the closed position to provide an effective cutting operation similar to the action of a pair of scissors, as best shown in FIG. 3.

The jaw portion 12 has a lateral extension 42 which terminates in a substantially cylindrically shaped hammer head 44, as best shown in FIG. 2. The hammer head 44 extends substantially outwardly of the handle portions 8 and 10 when they are in the closed position, thereby providing a conventional hammer configuration, as best shown in FIG. 1.

Figure 4:
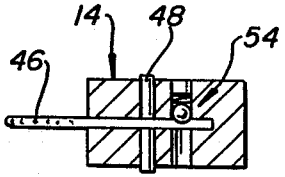
FIG. 4 is a sectional view taken along line 4—4 in FIG. 2.

The jaw portion 14 includes a lateral extension 43 which terminates in a blade 46 which is movable about a pivot 48 between an exposed position, as best shown in FIG. 2, and a closed protected position, as best shown in FIG. 1. A substantial portion of the blade 46 retracts into a recess 50 in the jaw portion 14 when the blade 46 is in the closed position, thereby advantageously preventing the blade 46 from accidentally cutting a user. The blade 46 includes an arcuate cutting edge 52 used for general cutting, such as cutting the plastic sheath and the paper filler of a Romex cable, cutting insulating tape, etc. A spring and ball arrangement 54 cooperates with a pair of depressions (not shown) on the blade 46 for locking the blade 46 in the exposed or closed position, as best shown in FIG. 4.

Figure 5:
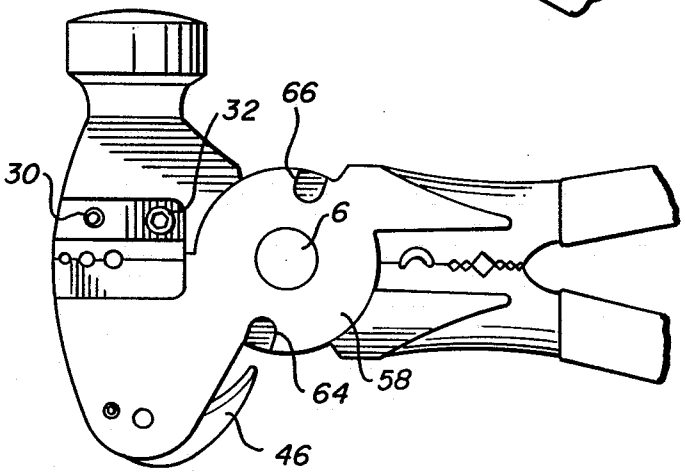
FIG. 5 is a fragmentary bottom plan view of the tool of FIG. 1.

The tool R includes substantially cylindrical bearing portions 56 and 58, as best shown in FIGS. 1, 5 and 6. The bearing portions 56 and 58 advantageously provide for a rigid construction about pivot 6.

The configuration of the jaw portions 12 and 14 and the bearing portions 56 and 58 contributes to a balanced weight distribution wherein its center of mass is preferably substantially adjacent the pivot 6 on the side of the handle portions 8 and 10. The weight distribution advantageously makes the tool R comfortable to handle, provides greater impact force for the hammer head 44, and provides greater mechanical advantage to the cutter blades 16 and 18.

The bearing portion 56 includes sleeves 60 and 62 disposed therethrough and adjacent an edge thereof and are substantially parallel to the axis of the pivot 6. The sleeves 60 and 62 are coextensive with the thickness of the bearing portion 56. The sleeves 60 and 62 have inner threads for engaging and cooperating with the thread of a bolt when positioned in the appropriate sleeves 60 and 62. The bearing portion 58 includes slots 64 and 66 disposed on an edge thereof and substantially parallel with the sleeves 60 and 62. The slots 64 and 66 are in alignment with their respective sleeves 60 and 62 when the handle portions 8 and 10 are in the open position, as best shown in FIG. 2, but are completely in non-alignment when the handle portions 8 and 10 are in the closed position, as best shown in FIGS. 1 and 5. The sleeves 60 and 62 cooperating with their respective slots 64 and 66 provide means for cutting a bolt placed in one of the sleeves 60 and 62.

The handle portions 8 and 10 includes a crimper 68 advantageously disposed adjacent the pivot 6 to utilize the greater leverage forces generated nearer the pivot 6. The crimper 68 includes a projection 70 disposed on the handle portion 8 and a cooperating recess 72 disposed on the handle portion 10, as best shown in FIGS. 1 and 2.

Disposed adjacent the crimper 68 and away from the pivot 6 is a pair of corrugated gripping surfaces 74, for gripping wires and the like. Each of the gripping surfaces 74 includes a V-shaped notch 76 disposed transversely to the handle portions 8 and 10. The notches 76 form a rectangular cross-section when the handle portions 8 and 10 are in the closed position, as best shown in FIG. 1. The gripping surfaces 74 also include longitudinal slots 78, each of which is in opposed orientation to each other when the handle portions 8 and 10 are in the closed position, as best shown in FIGS. 1 and 9. Surfaces 80 of the slots 78 advantageously form opposing ramp surfaces when the handle portions 8 and 10 are in the closed position, as best shown in FIG. 9.

The end portion of the handle portion 8 includes a claw 82 for prying nails and the like, as best shown in FIGS. 1 and 6. The end portion of handle portion 10 includes a screw driver blade 84, as best shown in FIGS. 1 and 8.

The handle portions 8 and 10 are appropriately shaped when in the closed position for a comfortable grip, as when using the tool R as a hammer. Each of the handle portions 8 and 10 includes outwardly extending intermediate portions 86 and inwardly extending end portions 88, as best shown in FIG. 1. The intermediate portions 86 conveniently prevent a user from accidentally jamming his or her fingers between the handle portions, while the end portions provide the user with a comfortable grip.

Each of the handle portions 8 and 10 includes a sheath 90 made of a resilient and insulating material for providing a comfortable grip and a measure of safety against accidental electrical contact.

The tool R is made of metal because of its known strength and durability. Appropriate portions of the tool R, such as the hammer face 44, crimper 68, gripping surfaces 78, screwdriver blade 82 or the claw 84 may be differentially hardened to withstand the stresses to which these portions are subjected.

OPERATION

The tool R includes most of the tools commonly used by an electrician in wiring a house or building.

The hammer head 44 is used for driving nails to secure electrical boxes to the wooden studs in a house, punching out knock-out holes in the electrical boxes, or for any purpose for which a hammer is needed.

The cutter blades 16 and 18 ar used to cut electrical wires to the proper length and to strip the insulation from their end portions. Romex cable which is normally used in house wiring includes two or more insulated wires and a bare wire within a protective plastic sheath. The end portions of the wire is exposed from the plastic sheath by slitting and cutting the plastic sheath. The blade 46 in the open position is used for this purpose. The blade 46 is also used for cutting any filler that is exposed after the sheath has been cut. The insulation of the exposed end portions of the wires are stripped for connecting to electrical devices, such as receptacles, switches, lighting fixtures, etc. When the blade 46 becomes dull or damaged, it is simply removed and replaced by undoing the pivot 48.

The end portions of the wires are stripped of their insulation by using any one of the cutters 28. The diameter of each of the cutters 28 is advantageously matched to the wire gauges normally used in house wiring, such as Nos. 10, 12, 14, etc. The insulation is cut and separated from the conductor by placing the wire in the appropriate cutter 28. When the blades 16 and 18 become dull or damaged, they can be easily replaced by simply undoing the bolts 32 and the spring metal pins 30.

A bolt used to secure an electrical device to its electrical box may be cut to a shorter length by threading it within one of the sleeves 60 and 62 until it protrudes a desired distance beyond the bearing portion 56 and into one of the slots 64 and 66 when the handle portions 8 and 10 are in the open position, as best shown in FIG. 2. Since the bolt is held in place by the cooperating threads of the sleeve and the bolt, the two hands of the user are therefore advantageously free to exert greater force to bring the handle portions 8 and 10 together to thereby shear the protruding portion of the bolt. The relatively longer handle portions 8 and 10 also advantageously provide relatively greater mechanical advantage.

The crimper 68 is used to join the bare wires converging in an electrical box. The bare wires are slid into a sleeve which is then crimped by the crimper 68, thereby securing the bare wires together. The crimper 68 can also be used for crimping conductor lugs and the like.

The gripping surfaces 74 are used for gripping wires and the like for positioning or pulling the wires through a conduit, between studs, etc.

The slots 78 are used for pulling a protruding nail 92 from a stud. The handle portions 8 and 10 are opened and then closed upon the nail head such that the nail shank is positioned between the notches 76. The ramp surfaces 80 advantageously provide a camming action for pulling the nail upwardly from the stud. The nail is then leveraged out of the stud with the handle portions 8 and 10 about the jaw portions 12 and 14. The claw 82 may also be used for lifting the nail out of the stud.

The screwdriver blade 82 may be used for punching out the knock-outs in an electrical box, in addition to driving screws.

While this invention has been described as having preferred design, it is understood that it is capable of further modification, uses and/or adaptations of the invention following in general the principle of the invention and including such departures from the present disclosure as come within known or customary practice in the art to which the invention pertains, and as may be applied to the essential features set forth, and fall within the scope of the invention or the limits of the appended claims.

I claim:

1. A hand tool, comprising:

(a) first and second members;

(b) means for pivotally connecting said first member to said second member;

(c) said first and second members including first and second handle portions, respectively, on one side of said connecting means and first and second jaw portions, respectively, on the other side of said connecting means;

(d) said first and second jaw portions being positionable between closed and open positions when said handle portions are brought together or spread apart, respectively;

(e) first and second cooperating cutter blades disposed on said first and second jaw portions, respectively, for cutting when said first and second jaw portions are closed;

(f) said first and second cutter blades including first and second straight cutting edge portions, respectively, and at least first and second arcuate edge portions, respectively;

(g) said at least first and second arcuate edge portions forming at least a circular cutter when said first and second jaw portions are closed;

(h) one of said first and second jaw portions including an outward transverse extension terminating in a hammer head extending laterally outwardly of said handle portions when brought together; and (i) the other of said first and second jaw portions including an outward transverse extension terminating in a pivotable knife blade having a first protected position and a second exposed position.

2. A hand tool as in claim 1, wherein:

(a) said cutter blade straight portions are disposed next to said connecting means; and (b) said at least first and second arcuate edge portions are disposed away from said connecting means.

3. A hand tool as in claim 1, wherein:

(a) said cutter blades are removably secured to said first and second jaw portions.

4. A hand tool as in claim 1, wherein:

(a) said at least first and second arcuate edge portions form a plurality of said circular cutters.

5. A hand tool as in claim 4, wherein:

(a) said circular cutters decrease in size in a direction away from said connecting means.

6. A hand tool as in claim 1, wherein:

(a) said knife blade includes an arcuate cutting edge.

7. A hand tool as in claim 1, wherein:

(a) said second jaw portion includes a groove; and (b) at least a portion of said knife blade is disposed within said groove.

8. A hand tool as in claim 7, wherein:

(a) said second jaw portion includes a lock means for maintaining said knife blade in said first protected and second exposed positions.

9. A hand tool as in claim 1, wherein:

(a) said first handle portion includes a third jaw portion; and (b) said second handle portion includes a fourth jaw portion.

10. A hand tool as in claim 9, wherein:

(a) said third and fourth jaw portions include gripping surfaces.

11. A hand tool as in claim 10, wherein:

(a) said gripping surfaces are corrugated.

12. A hand tool as in claim 9, wherein:

(a) said third and fourth jaw portions include a crimper.

13. A hand tool as in claim 12, wherein:

(a) said crimper is disposed adjacent said connecting means.

14. A hand tool as in claim 10, wherein:

(a) said third and fourth jaw portions include a crimper disposed adjacent said connecting means; and (b) said gripping surfaces are disposed away from said connecting means.

15. A hand tool as in claim 9, wherein:

(a) said third and fourth jaw portions each includes a longitudinal groove.

16. A hand tool as in claim 15, wherein:

(a) said third and fourth jaw portions each includes a V-shaped slot disposed transversely to said groove.

17. A hand tool as in claim 16, wherein:

(a) each of said grooves includes a ramp surface.

18. A hand tool as in claim 1, wherein:

(a) one of said first and second handle portions includes a screw driver blade at its free end portion.

19. A hand tool as in claim 1, wherein:
(a) one of said first and second handle portions includes a claw at its free end portion.
20. A hand tool as in claim 1, wherein:
(a) said first and second members include at least one bolt cutter.
21. A hand tool as in claim 20, wherein:
(a) one of said first and second members includes a hole disposed therethrough and adjacent said pivot;
(b) the other of said first and second members includes a cooperating slot alignable with said hole when said first and second handle portions are apart from each other;
(c) whereby a bolt positioned in said hole projects into said slot when said first and second handle portions are apart from each other and the bolt is sheared by said slot when said first and second handle portions are brought together.
22. A hand tool as in claim 21, wherein:
(a) said hole includes an interior thread for cooperating with the thread of a bolt to be cut.
23. A hand tool, comprising:
(a) first and second members;
(b) means for pivotally connecting said first member to said second member;
(c) said first and second members including first and second handle portions, respectively, on one side of said connecting means and first and second jaw portions, respectively, on the other side of said connecting means;
(d) said first and second jaw portions being positionable between closed and open positions when said handle portions are brought together or spread apart, respectively;
(e) first and second cooperating cutter blades disposed on said first and second jaw portions, respectively, for cutting when said first and second jaw portions are closed;
(f) said first and second cutter blades including first and second straight cutting edge portions, respectively, and at least first and second arcuate edge portions, respectively;
(g) said at least first and second arcuate edge portions forming at least a circular cutter when said first and second jaw portions are closed;
(h) one of said first and second jaw portions including an outward transverse extension terminating in a hammer head extending laterally outwardly of said handle portions when brought together;
(i) the other of said first and second jaw portions including an outward transverse extension terminating in a pivotable knife blade having a first protected position and a second exposed position;
(j) said first and second handle portions including third and fourth jaw portions having gripping surfaces; and
(k) said third and fourth jaw portions including a crimper.
24. A hand tool as in claim 23, wherein:
(a) said first and second members include at least one bolt cutter.
25. A hand tool, comprising:
(a) first and second members;
(b) means for pivotally connecting said first member to said second member;
(c) said first and second members including first and second handle portions, respectively, on one side of said connecting means and first and second jaw portions, respectively, on the other side of said connecting means;
(d) said first and second jaw portions being positionable between closed and open positions when said handle portions are brought together or spread apart, respectively;
(e) first and second cooperating cutter blades disposed on said first and second jaw portions, respectively, for cutting when said first and second jaw portions are closed;
(f) said first and second cutter blades including first and second straight cutting edge portions, respectively, and at least first and second arcuate edge portions, respectively;
(g) said at least first and second arcuate edge portions forming at least a circular cutter when said first and second jaw portions are closed;
(h) one of said first and second jaw portions including an outward transverse extension terminating in a hammer head extending laterally outwardly of said handle portions when brought together;
(i) the other of said first and second jaw portions including an outward transverse extension terminating in a pivotable knife blade having a first protected position and a second exposed position;
(j) said first and second handle portions including third and fourth jaw portions having gripping surfaces; and
(k) said first and second members including at least one bolt cutter.

* * * * *